US008950306B2

(12) United States Patent
Gambini

(10) Patent No.: US 8,950,306 B2
(45) Date of Patent: Feb. 10, 2015

(54) APPARATUS FOR CUTTING PAPER LOGS IN A PLURALITY OF ROLLS

(75) Inventor: Giovanni Gambini, Pisa (IT)

(73) Assignee: Gambini International S.A., Luxembourg (LU)

( * ) Notice: Subject to any disclaimer, the term of this patent is extended or adjusted under 35 U.S.C. 154(b) by 19 days.

(21) Appl. No.: 13/372,084

(22) Filed: Feb. 13, 2012

(65) Prior Publication Data

US 2012/0204691 A1 Aug. 16, 2012

(30) Foreign Application Priority Data

Feb. 15, 2011 (IT) ..... MI2011A0221

(51) Int. Cl.

| | |
|---|---|
| ***B26D 7/02*** | (2006.01) |
| *B26D 3/16* | (2006.01) |
| *B26D 7/01* | (2006.01) |

(52) U.S. Cl.

CPC ... *B26D 7/02* (2013.01); *B26D 3/16* (2013.01); *B26D 2007/013* (2013.01); *B26D 2210/11* (2013.01)

USPC ..... 83/457; 83/466; 83/462

(58) Field of Classification Search

USPC ..... 83/457, 460, 462, 463, 466, 466.1, 452, 83/379, 385; 269/132, 140, 268, 143, 249; 29/257, 276

See application file for complete search history.

(56) References Cited

U.S. PATENT DOCUMENTS

| | | | | | |
|---|---|---|---|---|---|
| 2,262,991 | A | * | 11/1941 | Arrigo | 83/456 |
| 4,339,116 | A | * | 7/1982 | Benz et al. | 269/132 |
| 4,463,635 | A | * | 8/1984 | Hafla et al. | 82/162 |
| 4,519,279 | A | * | 5/1985 | Ruggeri | 82/162 |
| 4,546,681 | A | * | 10/1985 | Owsen | 82/162 |
| 4,650,237 | A | * | 3/1987 | Lessway | 294/119.1 |
| 5,058,468 | A | * | 10/1991 | Lessway | 279/133 |
| 6,048,013 | A | * | 4/2000 | Moilanen et al. | 294/203 |
| 6,532,851 | B2 | * | 3/2003 | Moss et al. | 83/466 |
| 6,896,603 | B1 | * | 5/2005 | Lessway | 451/408 |
| 8,474,806 | B2 | * | 7/2013 | Orgeron | 269/218 |

FOREIGN PATENT DOCUMENTS

| | | | |
|---|---|---|---|
| EP | 0500405 | A1 | 8/1992 |
| WO | 0141982 | A2 | 6/2001 |
| WO | 02/49814 | A1 | 6/2002 |
| WO | 2004/094117 | A1 | 11/2004 |

* cited by examiner

*Primary Examiner* — Kenneth E. Peterson
*Assistant Examiner* — Jennifer Swinney
(74) *Attorney, Agent, or Firm* — Lucas & Mercanti, LLP

(57) ABSTRACT

An apparatus for cutting paper logs in a plurality of rolls is disclosed. The apparatus has at least one longitudinal input channel and at least one output channel defining circular housings and being arranged in a succession among them. The channels have mobile walls with an upper mobile portion and a lower mobile portion. The lower mobile portion is connected with a structure for supporting the apparatus on one side and with an intermediate portion of the upper mobile portion on another side. The upper mobile portion has a free upper end and a base end connected to a movable cursor. A mobile actuator for moving the walls, which engages the upper mobile portion at the base end is also provided.

6 Claims, 8 Drawing Sheets

APPARATUS FOR CUTTING PAPER LOGS IN A PLURALITY OF ROLLS

CROSS-REFERENCE TO RELATED APPLICATION

This application claims the benefit of priority from Italian Patent Application No. MI2011A 000221, filed Feb. 15, 2011, the contents of which are incorporated herein by reference.

FIELD OF THE INVENTION

The present invention relates to an apparatus for cutting paper logs in a plurality of rolls.

The apparatus object of the present invention is used in the industrial field of machines intended for making rolls, such as for example toilet paper, paper towels and/or the like.

In particular, the apparatus of the present invention falls within the devices intended for cutting long rolls of web material, in the field and in the following description referred to as "logs", in a plurality of rolls having predetermined length corresponding to the end product to be packaged.

BACKGROUND OF THE INVENTION

In general, the machines of this type known to date comprise at least one longitudinal channel for the input of one log and at least one output channel of rolls resulting from the cutting of such log.

Said channels, which define a circular housing provided with the diameter corresponding to the log and to the rolls to be processed, are arranged in a succession among them and separated by a cutting device, for example a vertical blade.

In such machines, therefore, the log is made to advance between the two channels arranged in a succession and at the passage between such channels it is cut into rolls of predetermined length.

During the cutting operations it is necessary to keep the log stably constrained to the machine in order to prevent cutting errors and consequent sizing errors of the finished rolls.

To this end, the housings defined by the channels are usually sized expressly according to the diameter of the logs to be cut.

However, such embodiments exhibit the big drawback of allowing the cut of logs having the same size only.

In such machines, in fact, as the log sizes change it is necessary to stop the machine and proceed to the manual replacement of the channels with other ones having an adequate size for the new logs fed.

WO02/49814 describes an apparatus for cutting paper logs in a plurality of rolls according to the preamble of claim 1. In particular, WO02/49814 provides for circular housings for receiving the logs which comprise mobile walls for selectively varying the diameter of the same housings between a maximum diameter and a minimum diameter.

Each wall comprises an upper mobile portion and a lower mobile portion.

The lower mobile portion is connected through pins with a supporting structure on one side and with an intermediate portion of the upper mobile portion on another side.

The upper mobile portion comprises a free upper end and a base end rotatably connected to a cam.

Such cam consists of a mobile cursor in a slot inclined between a first position that corresponds to the maximum diameter of the circular housings and a second position that corresponds to the minimum diameter of the circular housings.

The movement and clamping of the housings about the logs is controlled by a particular type of actuator which acts above the housings on the free ends of the mobile walls.

As can be seen in FIG. 1 of WO02/49814, in fact, a sort of cover element is provided arranged above the housings, vertically mobile and provided with wedge elements that during the down stroke clamp the mobile walls against the logs. Such embodiment exhibits some drawbacks, among which that of deforming the logs.

In fact, such machine for exerting a predetermined side containment force on the housing walls also generates a corresponding vertical compression force on the log.

Contrary to the side containment force, the vertical compression force is not cushioned by any spring element and is directly relieved onto the frame which, being non-deformable, transfers it to the log by reaction, causing the deformation thereof. Moreover, the presence of a cover as described in WO02, that is, of the type pressed against the housings, exhibits the further drawback of interfering with the advance of the logs that could in fact bang against the same cover.

The object of the present invention is to provide an apparatus for cutting paper logs in a plurality of rolls alternative to the known embodiments of the type described in WO02/49814 and capable of solving the drawbacks of the prior art mentioned above in a very simple, inexpensive and particularly functional manner.

Another object is to provide an apparatus for cutting paper logs in a plurality of rolls capable of processing logs of various sizes without requiring the stop of the apparatus and the manual intervention of an operator and without the risk of deforming the log.

These objects according to the present invention are achieved by making an apparatus for cutting paper logs in a plurality of rolls according to claim 1. Further features of the invention are described in the dependent claims.

BRIEF DESCRIPTION OF THE INVENTION

The features and the advantages of an apparatus for cutting paper logs in a plurality of rolls according to the present invention will appear more clearly from the following exemplifying and non-limiting description with reference to the annexed schematic drawings, wherein.

DETAILED DESCRIPTION OF THE INVENTION

Figure 1:
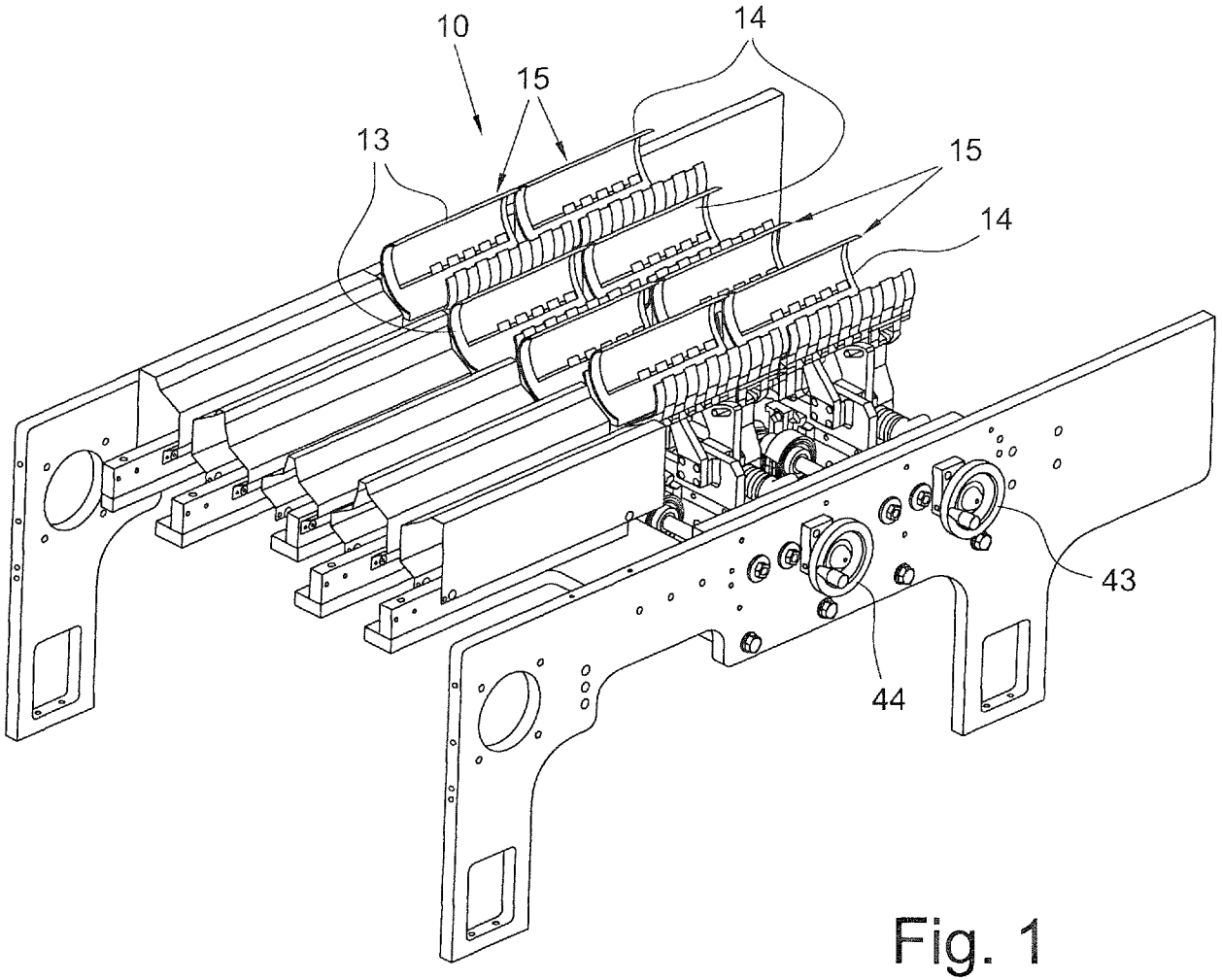
FIG. 1 is a schematic perspective view of an apparatus for cutting paper logs in a plurality of rolls according to the present invention.
Figure 2:
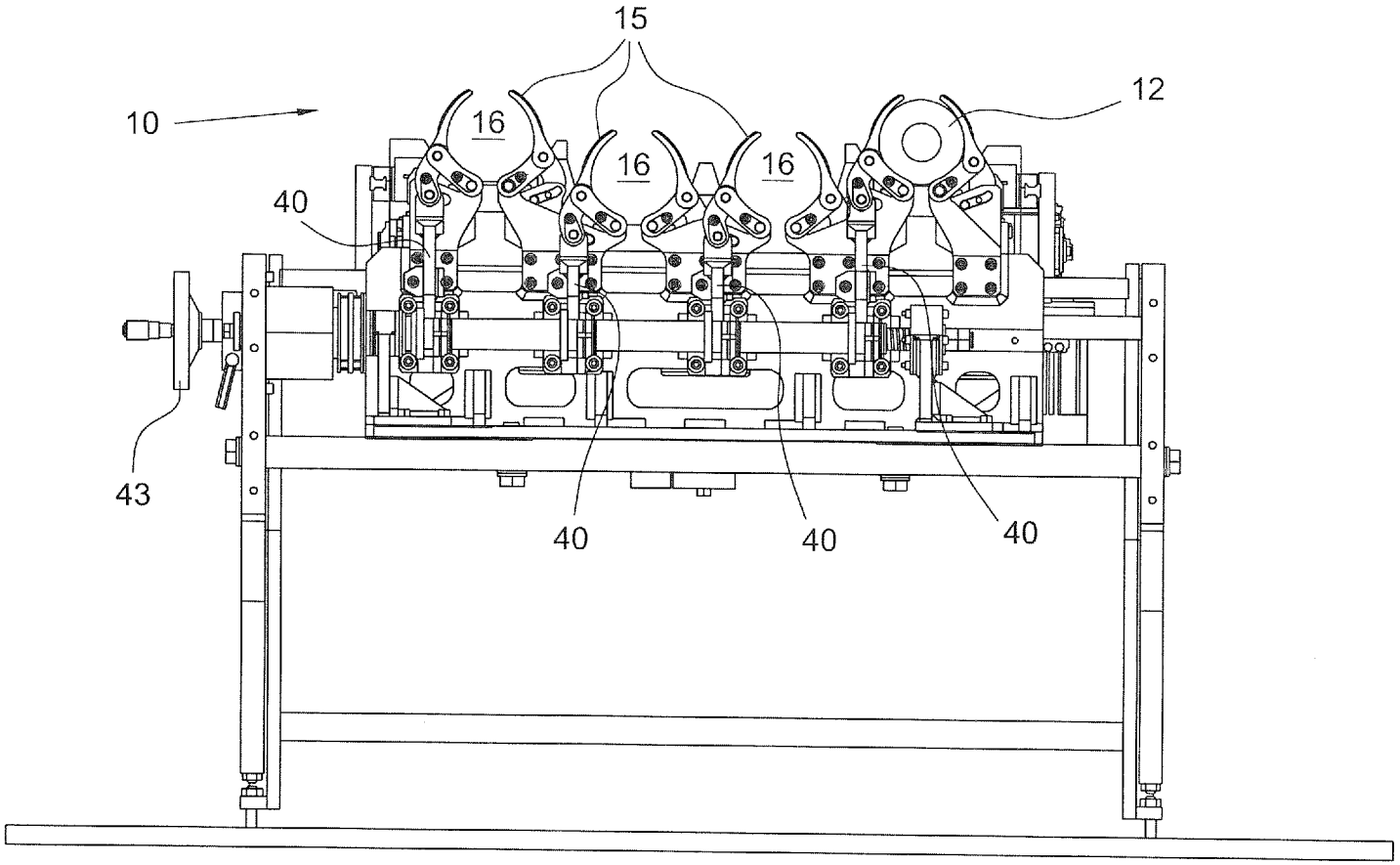
FIG. 2 is a front elevation view of the apparatus of FIG. 1 during the cut of a small-sized log.
Figure 3:
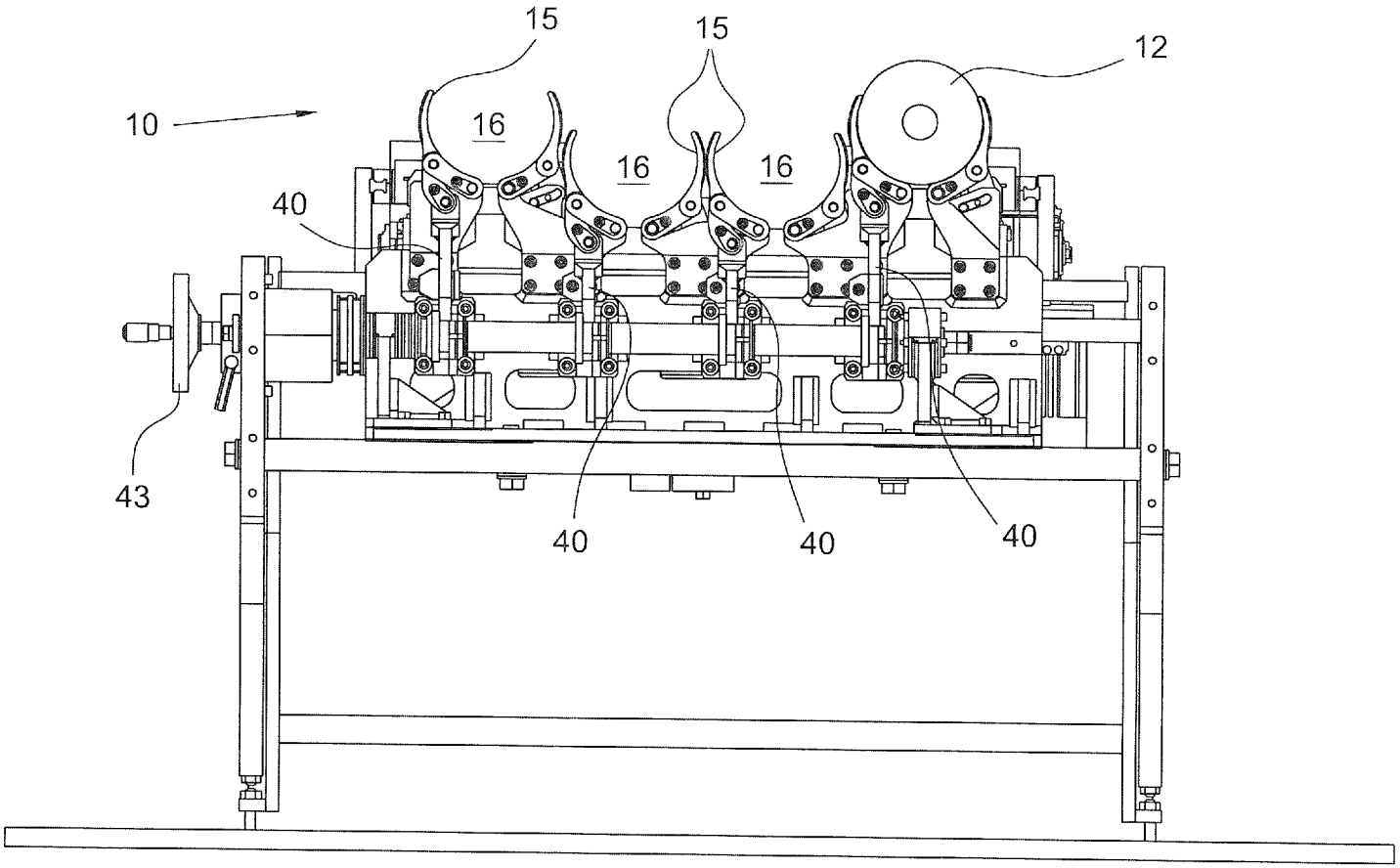
FIG. 3 is a front elevation view of the apparatus of FIG. 1 during the cut of a larger log than the log shown in FIG. 2.
Figure 4:
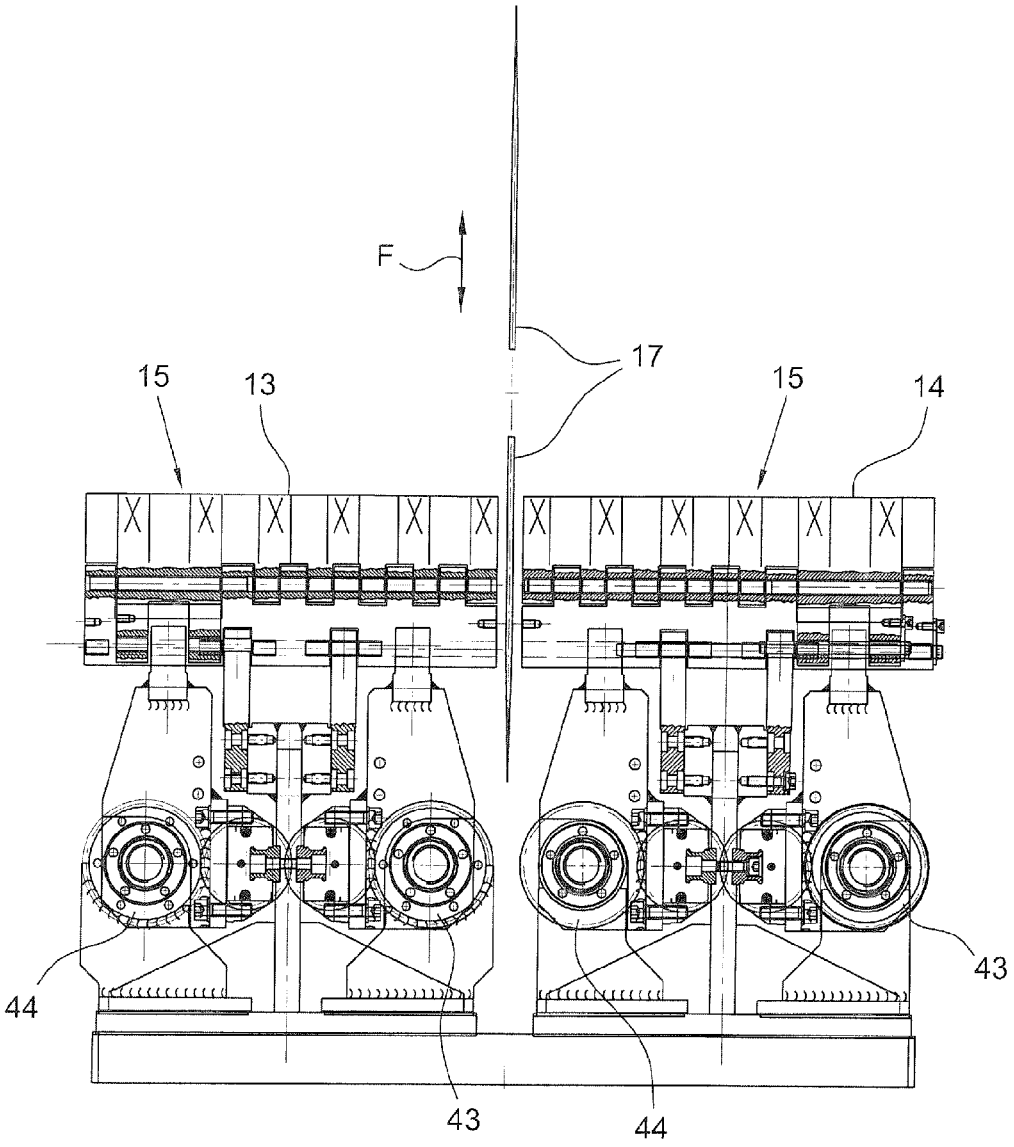
FIG. 4 is a side elevation view of the apparatus of FIG. 1 wherein a log blade cutting member is schematically shown.
Figure 5:
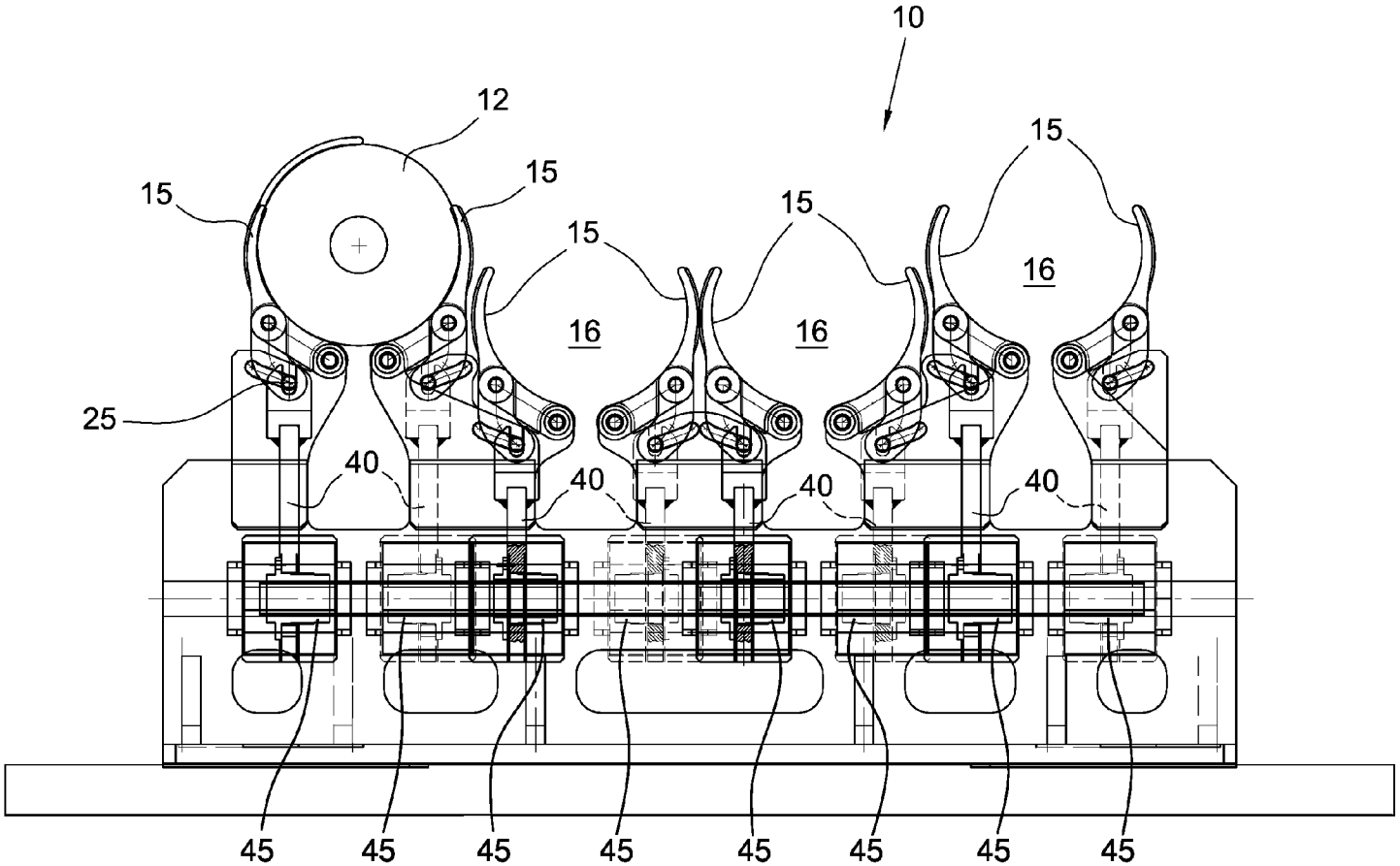
FIG. 5 is an enlarged view of the apparatus of FIG. 1.
Figure 6:
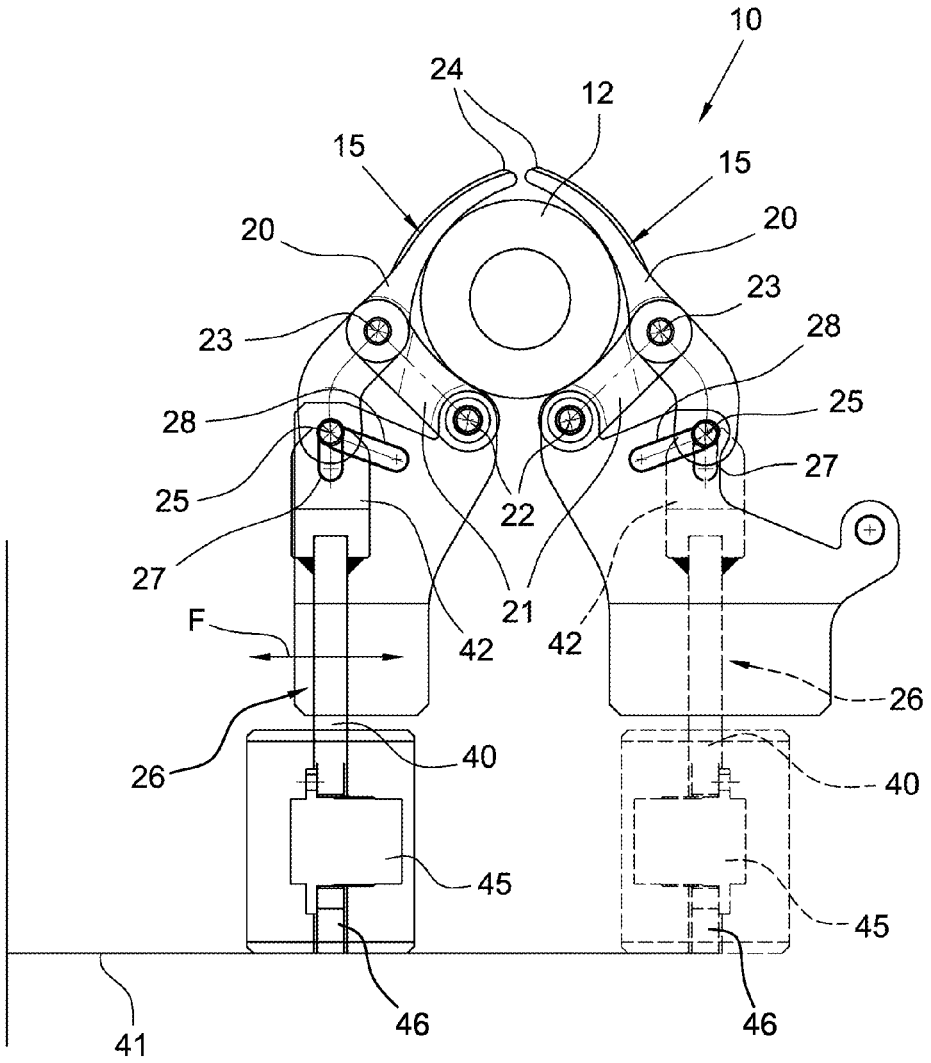
FIG. 6 is a detail of the apparatus of FIG. 5.
Figure 8:
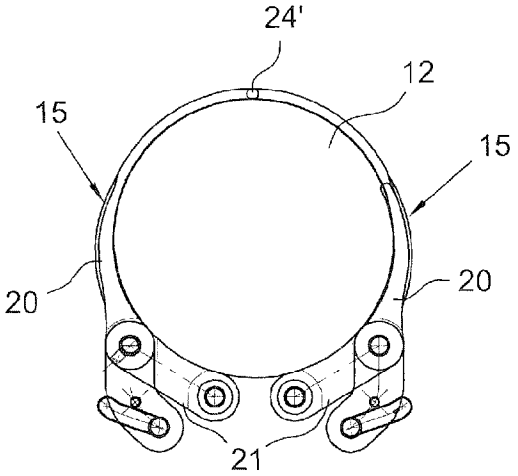
FIGS. 7-11 show different embodiments of the detail of FIG. 6.
Figure 10:
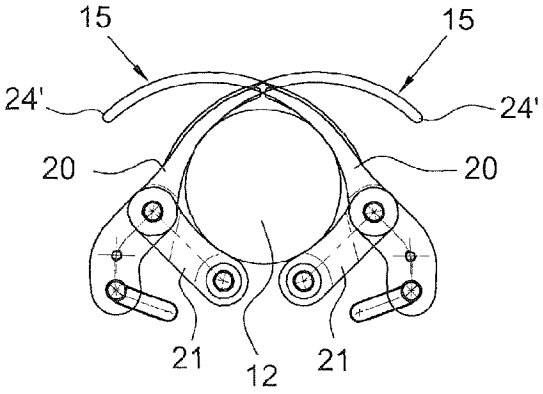
Figure 7:
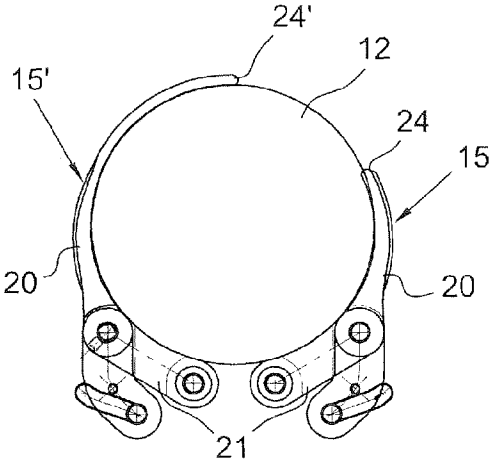
Figure 9:
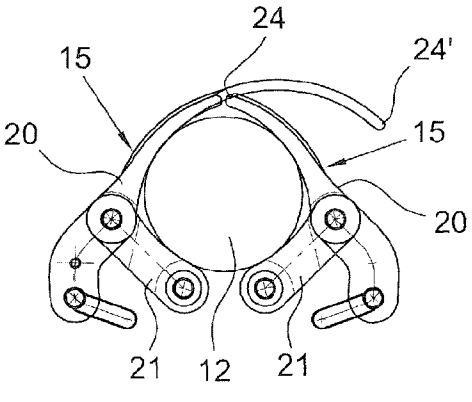
Figure 11:
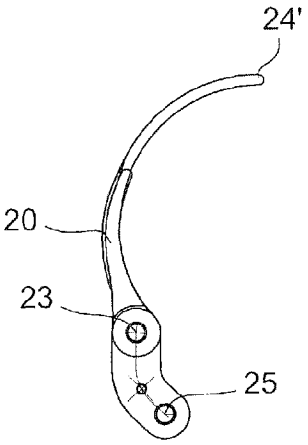
Figure 12:
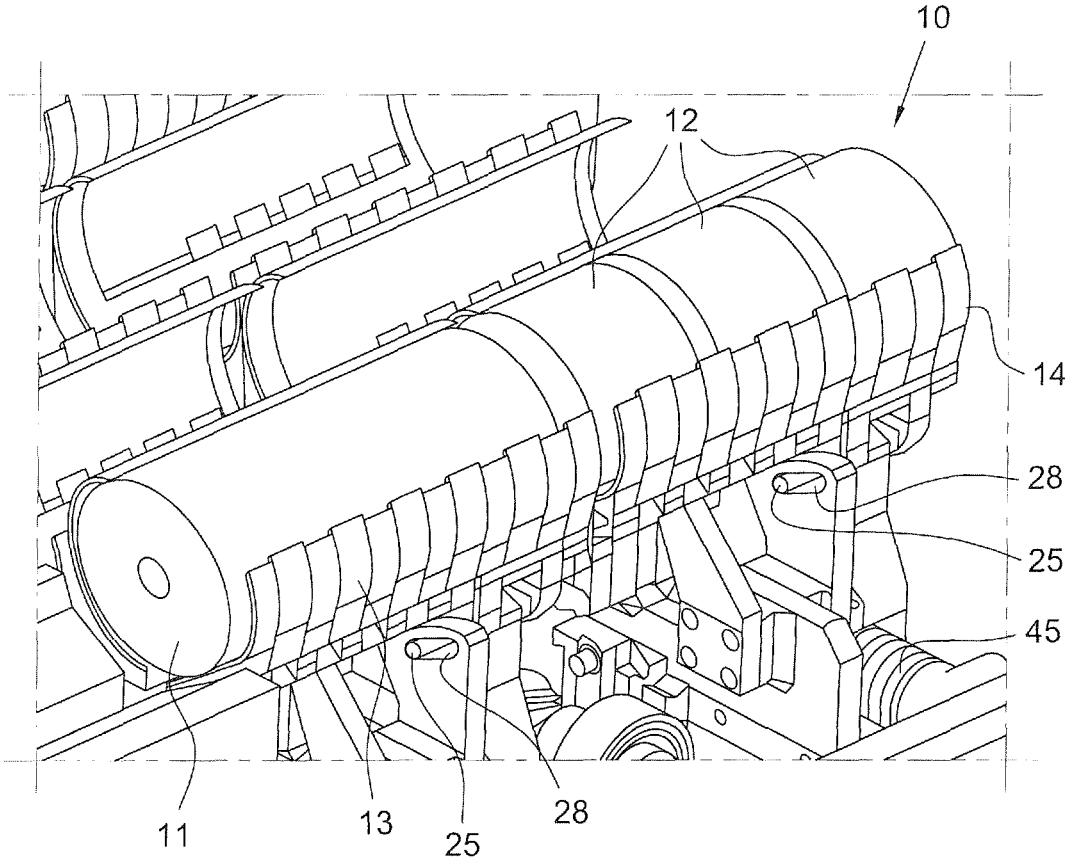
FIG. 12 is a schematic perspective view of an apparatus of FIG. 1 during the cut of a log.

With reference to the figures, reference numeral 10 shows an exemplary embodiment of an apparatus for cutting paper logs 11 in a plurality of rolls 12 according to the present invention.

Such apparatus 10 comprises at least one longitudinal input channel 13 of a log 11 and at least one output channel 14 of the finished rolls 12.

In the embodiments shown there are four parallel channels but any number of channels may be envisioned according to the needs.

Channels 13, 14 are arranged in succession among them, are separated by a cutting device 17, for example with blade, and define substantially circular housings 16 having such dimensions as to stably receive log 11 and rolls 12.

As for the machines known to date, means (not shown) are provided for moving logs 11 and rolls 12 along the relative channels 13, 14 upstream and downstream of blade 17.

In particular, according to the invention, channels 13, 14 comprise mobile walls 15 so as to selectively vary the diameter of the circular housings 16 for ensuring the stable reception of logs 11 and rolls 12 of various sizes.

According to the preferred embodiment shown in the figures, each one of walls 15 comprises an upper mobile gripping portion 20 and a lower mobile supporting portion 21 for logs 11 and rolls 12.

In particular, the lower mobile supporting portion 21 for logs 11 and rolls 12 is connected through pins 22, 23 with a supporting structure on one side and with an intermediate portion of the upper mobile gripping portion 20 on another side.

At the same time, the upper mobile gripping portion 20, generally C-shaped, comprises an upper free end 24 and a base end rotatably connected with a cursor 25 mobile in an inclined slot 28 obtained in the fixed structure.

In particular, such cursor 25 is moved by a mobile actuator 26, for controlling the movement of walls 15.

Cursor 25 is therefore mobile between a first end of the slot 28 which corresponds to the maximum diameter of the circular housings 16, and a second end which corresponds to the minimum diameter of the circular housings 16.

According to the invention, the mobile actuator 26 is configured so as to engage the upper mobile gripping portion 20 at the base end without generating any vertical compression force of the log towards the apparatus base.

In fact, as may be seen in the figures, the upper portion of housings 16 is free and no cover element weighs on them for clamping walls 15. The absence of cover elements pressed against the housings facilitates the log advance within the same housings.

Advantageously, the mobile actuator 26 directly engages cursor 25 for moving it into the inclined slot 28.

According to the example shown, the mobile actuator 26 comprises at least one pusher element 40 acting against cursor 25 where such pusher 40 is of the type shifting along a direction F parallel to the supporting surface 41 of apparatus 10.

The pusher element 40 comprises a rod element 46 orthogonal to the supporting surface 41 of apparatus 10 and is provided with a first end constrained to a screw 45 for advancing the same pusher 40 and a second free end 42 coupled to cursor 25.

In order to allow both the horizontal motion forced by pusher 40 and the vertical motion forced by the inclined slot 28 to cursor 25, the second free end 42 of the pusher element 40 comprises a vertical fork housing, or open slot 27 for containing cursor 25.

In the exemplary embodiment shown in the figures, the inclined slot 28 has such inclined pattern that by the effect of the shifting of cursor 25 moved by actuator 26, both cursor 25 and the upper mobile gripping portion 20 and the lower mobile supporting portion 21 are moved upwards.

According to two alternative embodiments, the movements of walls 15 of each housing 16 may be synchronized with each other automatically or controlled independently.

In particular, all pushers 40 acting on a same side of housings 16 may be controlled in a synchronized manner between each other by means of knobs 43, 44 protruding laterally from apparatus 10.

In other words, acting on a knob 43 will move all the right-hand walls 15 of housings 16 and knob 44 will move the left-hand walls 15.

In that case, the screw element 45 extends along the entire apparatus and supports all pushers 40 acting on a same side of housings 16.

Moreover, through dedicated transmissions, pushers 40 acting on one side of housings 16 may be synchronized with those acting on the other side.

In this case, acting on a single knob will move both walls 15 of housings 16 in a synchronized manner.

Finally, according to some of the possible embodiments, a wall 15' of a pair defining a housing 16 may exhibit a development greater than the other wall 15, or both walls 15 may exhibit free comb-shaped ends staggered among them so as to allow the mutual partial penetration and surround logs 11 in an optimal manner.

It is very easy to understand the operation of the apparatus for cutting paper logs in a plurality of rolls object of the invention.

Logs 11 of any size are fed into channel 13 upstream of the cutting blade 17.

Actuators 16 are activated according to the log diameter which, acting on cursor 25, move walls 15 of the same channel 13.

By the effect of the geometry of portions 20, 21 which form walls 15 and of pins 22, 23, as the cursor position along the relative slot 28 varies, the diameter of housing 16 wherein log 11 lies is increased or decreased as desired.

Of course, such adjustments are also carried out for channel 14 downstream of blade 17.

It has thus been seen that an apparatus for cutting paper logs in a plurality of rolls according to the present invention achieves the objects described above.

In fact, the apparatus for cutting paper logs in a plurality of rolls according to the present invention offers an alternative solution to the machines known to date and is capable of precisely cutting logs of various sizes without requiring the stop of the apparatus or the manual intervention of an operator.

In particular, since no element weighing onto the housings is provided, any possible vertical crushing of the logs against the apparatus base is prevented.

Several changes and variations may be made to the apparatus for cutting paper logs in a plurality of rolls according to the present invention thus conceived, all falling within the same inventive concept; moreover, all details may be replaced with technically equivalent elements. In the practice, the materials used as well as the sizes thereof may be of any type, according to the technical requirements.

The invention claimed is:

1. Apparatus for cutting paper logs in a plurality of rolls comprising at least one longitudinal input channel of said log and at least one output channel of said rolls, said channels defining circular housings for stably receiving said log and said rolls and being arranged in a succession among them and separated by a cutting device of said log in said rolls, said channels comprising mobile walls for selectively varying the diameter of said circular housings between a maximum diameter and a minimum diameter for ensuring the stable reception of log and rolls of various dimensions, each one of said walls comprising an upper mobile gripping portion and a lower mobile supporting portion for said logs and rolls, said lower mobile supporting portion for said logs and rolls being connected through pins with a structure for supporting said apparatus on one side and with an intermediate portion of said upper mobile gripping portion on another side, said upper mobile gripping portion comprising a free upper end and a base end rotatably connected to a cursor movable within an inclined slot obtained in said structure between a first position that corresponds to said maximum diameter of said circular housings and a second position that corresponds to said minimum diameter of said circular housings, there being provided a mobile actuator for moving said walls, wherein said mobile actuator engages said upper mobile gripping portion at said base end and directly engages said cursor for moving it into said inclined slot, wherein said movable actuator comprises at least one pusher element acting against said cursor, said pusher being of the type shifting along a direction (F) parallel to the supporting surface of said apparatus between a first position wherein it constrains said cursor to a first end of said slot and a second position wherein it constrains said cursor to a second end of said slot, wherein said pusher element comprises a rod element orthogonal to the supporting surface of said apparatus provided with a first end constrained to a screw parallel to the supporting surface of said apparatus for advancing said pusher and a second free end coupled to said cursor, wherein said second free end of said pusher element comprises a fork or open vertical slot portion of containment and sliding for said cursor.

2. Apparatus according to claim 1, wherein it comprises a plurality of circular housings parallel to each other and a plurality of pusher elements acting against said walls, all the pushers being independent of each other.

3. Apparatus according to claim 1, wherein it comprises a plurality of circular housings parallel to each other and a plurality of pusher elements acting against said walls, all the pushers acting on a same side of said housings being controlled between each other in a synchronized manner by means of knobs protruding laterally from said apparatus.

4. Apparatus according to claim 3, wherein the pushers acting on one side of said housings are synchronized with the pushers acting on the other side of said housings.

5. Apparatus according to claim 1, wherein a wall of a couple of said walls defining said housing has a development greater than the other wall.

6. Apparatus according to claim 1, wherein said walls have free comb-shaped ends staggered among them so as to permit the mutual partial penetration.

* * * * *